United States Patent [19]

Maksymiak et al.

[11] 3,999,849

[45] Dec. 28, 1976

[54] TOUCHDOWN AMBIPOLAR DEVELOPMENT

[75] Inventors: John Maksymiak, Pennfield; Lawrence M. Hart, Ontario, both of N.Y.

[73] Assignee: Xerox Corporation, Stamford, Conn.

[22] Filed: Dec. 9, 1974

[21] Appl. No.: 530,631

[52] U.S. Cl. ..... 355/3 DD

[51] Int. Cl.[2] ..... G03G 15/00

[58] Field of Search ..... 355/3 DD, 14; 118/637

[56] References Cited

UNITED STATES PATENTS

| | | | |
|---|---|---|---|
| 3,696,785 | 10/1972 | Andrus | 355/3 DD X |
| 3,739,748 | 6/1973 | Rittler et al. | 355/3 DD X |
| 3,890,929 | 6/1975 | Walkup | 355/3 DD X |
| 3,893,418 | 7/1975 | Liebman et al. | 355/3 DD X |

OTHER PUBLICATIONS

Schaffert, R. M., "Development of Electrostatic Images," IBM Technical Disclosure Bulletin, vol. 1 No. 3, Oct. 1958, p. 6.

*Primary Examiner*—Fred L. Braun

*Attorney, Agent, or Firm*—James J. Ralabate; Eugene F. Miller; William A. Henry II

[57] ABSTRACT

In touchdown-type development systems used in xerographic apparatus, an arrangement produces ambipolar development of the latent image. The arrangement utilizes only changes in electric potential in various portions of the development process to effect a polarity change from positive-to-positive (direct) development to reversal development and vice versa.

8 Claims, 1 Drawing Figure

TOUCHDOWN AMBIPOLAR DEVELOPMENT

BACKGROUND OF THE INVENTION

This invention relates to xerographic systems and, more particularly, to the development of latent images in touchdown development systems.

The xerographic process as disclosed in Carlson's U.S. Pat. No. 2,297,691, encompasses a xerographic plate comprising a layer of photoconductive insulating material on a conductive backing. This plate is provided with a uniform electric charge over its surface and is then exposed to a light image representing the subject matter to be reproduced. The light exposure discharges the plate areas in accordance with the light radiation intensity that reaches it and thereby creates a latent, electrostatically charged image on or in the photoconductive layer. Development of the latent image is effected with an electrostatically charged finely divided material, such as an electroscopic powder called toner, that is brought into surface contact with the photoconductive layer and is held thereon electrostatically in a selective pattern corresponding to the latent electrostatic image. Thereafter, the developed image may be fixed by any suitable means to the surface on which it has been developed or the developed image may be transferred to a secondary support surface to which it may be fixed or utilized by means known in the art.

Once the electrostatic image is formed, the method by which it is made visible is the developing process. Various developing systems are well known in the art and include cascade, brush development, magnetic brush, powder cloud and liquid development. Still another developing method is disclosed in Mayo, U.S. Pat. No. 2,895,847 in which a support member, called a "donor,"is employed to present a releasable layer of electroscopic (toner) particles to the photoconductive layer for deposit thereon in conformity with the electrostatic image. The Mayo approach is one of several variations which involve the transfer of toner particles from a donor to the photoconductive surface and is therefore called transfer development. This technique is also known as "touchdown development."

Efforts have been made in the past to provide flexibility in a xerographic machine to change from a positive-to-positive (direct) or positive-to-negative (reversal) developing process. These approaches included systems with touchdown development or other development processes. This choice of development polarity is called ambipolar development.

Of the several approaches to ambipolar development now in use, none is fully satisfactory for a variety of reasons. One process of development employs what is called a reversal developer which is used on the Model 1824 xerographic machine made by the Xerox Corporation. In this machine, a change in the mode of development (e.g., positive-to-positive to negative-to-positive) is effected by replacing the entire developer.

Another approach to ambipolar development employs a non-standard photoreceptor which is photoconductive in either a positive or negative charged mode. (Standard selenium photoreceptors are usually photoconductive only in the positively charged mode).

Another ambipolar developer employed the use of positive and reversal coated carrier beads: such a system is limited to line copy systems only because of difficulties in the development of solid area images.

There has therefore been a need for a provision in xerographic machines whereby clear solid area and line image can be effected together with ambipolar development without major modification to the machine or without using sophisticated or non-standard components.

SUMMARY OF THE INVENTION

It is accordingly an object of the present invention to provide an ambipolar development arrangement in a touchdown development system.

It is also an object of the present invention to provide an ambipolar development arrangement in a touchdown system where good solid area and line copy is achieved.

It is another object of the present invention to effect ambipolar development while using a standard photoreceptor.

It is a further object of the present invention to provide ambipolar development wherein no physical changes need be made to the developing station or photosensor elements.

It is a still further object of the present invention to provide ambipolar development in a touchdown system by changing electrical parameters only.

It is an additional object of the present invention to provide ambipolar development in a xerographic machine which may be effected by a simple control which may be used by the operator.

In accordance with the present invention, in xerographic apparatus of the type having a photosensitive xerographic plate, means for charging the plate to a voltage $V_0$, means to expose the charged plate to a light image resulting in a latent charged image and means for developing the latent image employing a touchdown donor having a surface adapted to being selectively charged, an improvement is directed. The improvement in such apparatus comprises means for charging the toner particles to a negative potential during direct development of a positive latent image and for charging the toner particles to a positive potential during reversal development of a latent image, means for charging the surface of the donor in the touchdown area to a positive potential substantially less than $V_0$ but greater than the lowest background potential on the photosensitive plate during positive development of a positive image and for charging the surface of the donor at touchdown to a positive voltage which is less than $V_0$ but substantially greater than the average image level potential on the photosensitive plate, and means for selecting a mode of development.

Other objects and features of the present invention will become apparent by reference to the following description and drawings while the scope of the invention will be pointed out in the appended claims.

DETAILED DESCRIPTION OF THE INVENTION

Figure 1:
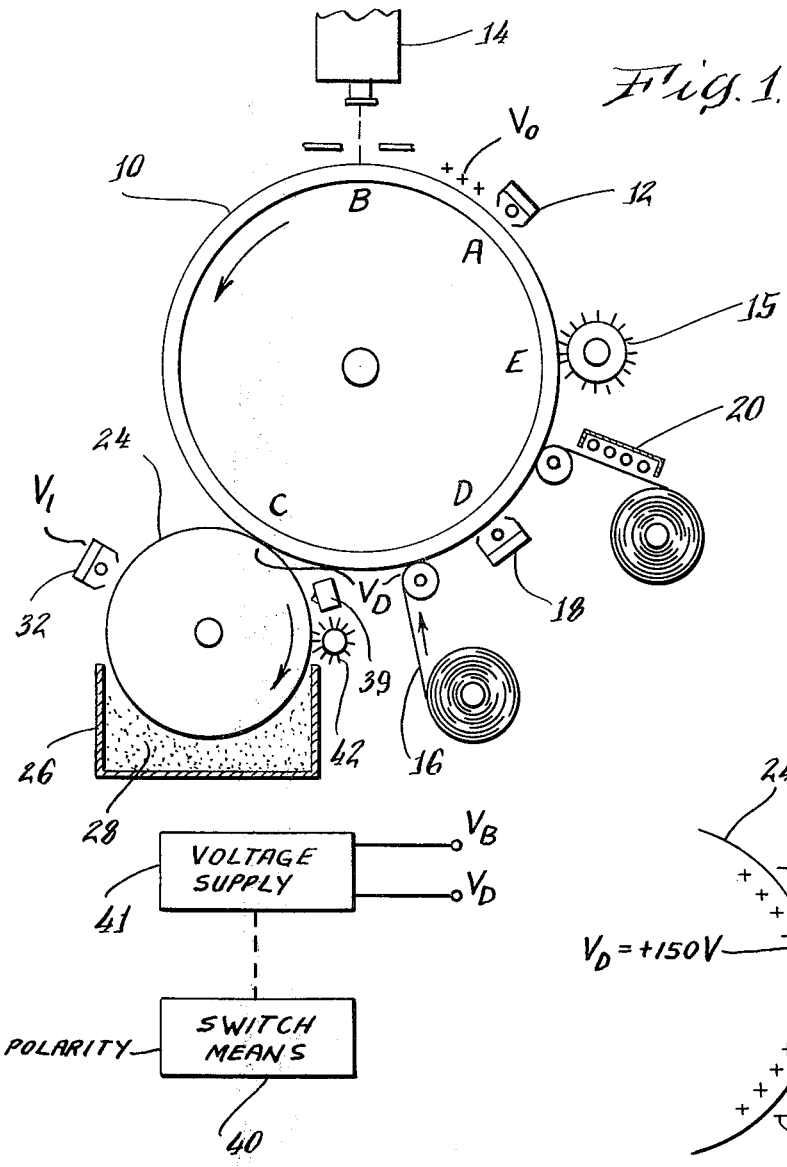
FIG. 1 illustrates in schematic representation a system employing touchdown development including means to effect ambipolar development in accordance with the present invention.

Referring initially to FIG. 1, shown there is a xerographic reproduction system in accordance with the present invention. The system comprises a xerographic photoconductive plate in the form of cylindrical drum 10. Other forms of photoreceptor plates may be used including endless belts. The drum is driven by conventional means which rotates the surface through stations A – E as indicated in the figure. The drum has a suitable photosensitive surface, which may, for example, include selenium or selenium alloys overlying a layer of conductive material, upon which a latent electrostatic image can be formed. Such surfaces are standard and known in the art. The various stations about the periphery of the drum are the charging station A, exposing station B, developing station C, transfer station D, and cleaning station E.

At the charging station A, suitable charging means 12, such as a corotron, places a uniform electric charge on the photoconductive surface. The charge potential due to the charging corotron is designated as $V_o$. For a standard selenium or selenium alloy photoconductor, a positive charge is placed on it by the charging means 12. As the drum rotates, the charged area is brought to station B where a suitable exposing device 14 supplies the light image to be reproduced. In the background areas of a positive image (maximum light portion of the light image) most of the charge on the photoreceptor will be dissipated. In the darker areas of the light image, the charge remaining on the photo receptor will be greater, up to a level of $V_o$.

An electrostatic latent image is thus formed on the surface of the drum. This image is then developed at station C by the application of a finely divided, pigmented, resinous powder called toner. The developed image then passes through transfer station D which includes the copy sheet 16, corona charging device 18 and fusing element 20. The last station E performs the function of cleaning the surface of the photo receptor such as with the use of brush 15 or any other conventional device.

Referring particularly to the developing station C of Fig. 1, a donor member 24 is shown which is preferably rotatable in the direction indicated. A suitable donor member is as described in U.S. Pat. No. 3,696,783 to Fantuzzo. Other donor members may also be appropriate. Such a donor member is constructed as a metallic drum which may be aluminum, over the surface of which is coated a dielectric layer, which can be a dielectric enamel. A conductive screen pattern is positioned over the dielectric layer. The aluminum supporting portion of the donor member 24 is electrically grounded by conventional means. The conductive screen, however, is brought to a predetermined potential.

Station C also includes a toner reservoir 26 containing toner particles 28. The donor member or roll 24 is positioned so that a portion of its periphery comes into contact with the toner 28. Also located around the donor roll 24 are charging means 32 and 39. Charging means 32, which may be a corona charging device, is adapted to place a uniform charge on the toner particles of predetermined polarity. The voltage supply for this device in FIG. 1 is designated as $V_B$. Charging means 39, also typically a corona charging device, is for neutralizing the donor to aid in the removal of residual toner by cleaning means 42. It is preferred in this arrangement for the donor member 24 to be spaced apart from the drum 10 by a small gap, typically 1 to 10 mils.

The conductive screen of the donor member may be brought to an appropriate voltage, designated $V_D$ in FIG. 1, by way of a slip ring so that its potential may be varied between ground potential and a charge potential at different stages in the process. As further described in U.S. Pat. No. 3,696,783, it may be desired, for example, for a donor to have many processing stations which would include 1) a toner loading station, 2) an agglomerate removal station (to remove excessive buildup of toner), 3) a uniform charging station, 4) a cleanup station (e.g., vacuum means), 5) a developing station, and 6) a cleaning station. These various stations require different voltages on the donor. These different voltages may be effectuated in different turns of the donor roll 24 or may be effected by the programmed split rings described in the Fantuzzo patent, U.S. Pat. No. 3,696,783. In any case, donor development station C encompasses means to provide appropriate voltages to the donor at appropriate times of the development cycle.

With the above description of the touchdown process in mind, the arrangement for providing ambipolar development will now be described. FIG. 1 illustrates appropriate blocks 40 and 41 to control the selection of mode of the development process (i.e., direct or reversal). Block 40 is a development polarity switch means which provides opportunity for the operator to select positive-to-positive (direct) or reversal polarity development. The switch means controls the magnitude and polarity of the voltage supply 41 which directly supplies voltages $V_B$ and $V_D$ of the xerographic apparatus.

The arrangement of the development mode in positive-to-positive image reproduction requires that the toner is corona charged to a negative polarity and the potential on the donor is such that there is a slight suppressing electric field in the background area. This may be achieved by maintaining the voltage level on the donor at touchdown about 50 to 100 volts above the potential on the surface of the photoconductor in the background areas of the image. For a selenium or selenium alloy photosensitive xerographic plate, the charging potential range is +700 to +1000 volts and the minimum background potential expected is about +50 volts. The normal range of negative toner charge for good image development is from 3 to 8 $\mu$ coulombs/gram. Accordingly, the donor at touchdown should be in the approximately +60 to +200 volt range with a choice of potential depending on expected background potential. Typical values for this mode are $V_o = +800^v$; $V_D = +150^v$ and V background = 0 + 100V. (The potential $V_T$ is not expressly stated since there are several factors contributing to the resulting charge on the toner, e.g., toner layer thickness, corotron characteristic curve, process speed, etc. The parameters are chosen so that the negative toner charge is in the range specified above.)

Figure 2:
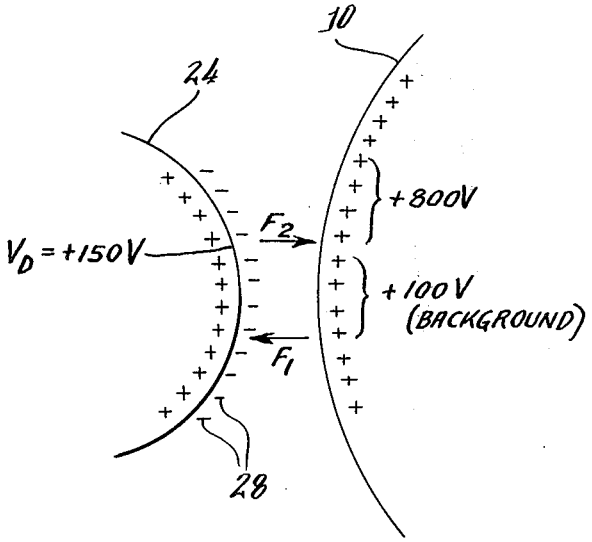
FIGS. 2 and 3 illustrate in schematic side view the charge distribution of the developer and photoreceptor in the two modes of development.

Operation of the developing station in positive-to-positive direct operation is explained with reference to FIG. 2. As shown in the figure, the surface of the donor 24 at touchdown is positive and is at the typical potential of $+150^v$. The negatively charged toner 28 rides on the surface of the donor 24. The background level of the photoconductor 10 is seen to be charged to $+100^v$ which is somewhat less than the donor potential level at touchdown. Accordingly, toner particles juxtaposed to the background levels will be retained on the donor 24 and will be forced away from the background portions. The position of the latent image on the surface of the photoconductor 10 will receive toner particles in proportion to the potential at that point. Those portions charged to much greater than +150 volts receive the densest portion of toner particles. The direction of the force on the toner particles at background and high potential portions are indicated as $F_1$ and $F_2$ respectively in the figure.

In the negative-to-positive reversal mode (or positive-to-negative), the toner is corona charged to a positive polarity and the field at the touchdown step is such that the toner will develop the discharged areas of the photoreceptor. In this arrangement, the donor is provided with a positive potential which is slightly less than the $+V_o$ potential in the undischarged areas of the latent image. This will provide a suppressive field on the positive toner particles in those areas. A potential difference of 60 to 200 volts between donor and $+V_o$ is preferred. Typical values of potential at the various critical points are $V_o = +800V$, $V_p = +700V$, V image = +400V. The positive toner particles are charged to approximately the same range as the negative toner particles, i.e., 3 – 8 $\mu$ coulombs/gram.

Figure 3:
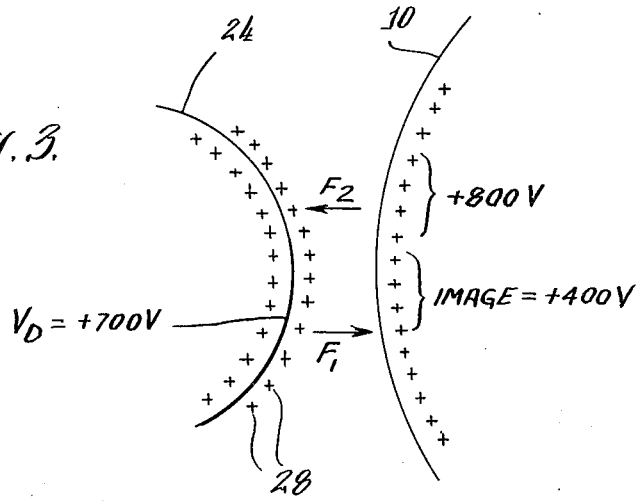

In FIG. 3, operation of this mode is shown. The surface of the donor 24 at touchdown is at a high positive potential which typically is 100 volts less than the potential at which the photoreceptor 10 is initially charged. Accordingly, if the photoreceptor 10 is initially charged to +800 volts, the donor is typically charged to +700 volts. The toner is charged to a positive potential. The toner rides on the surface of the donor by electrostatic attraction. In the undischarged portion of the latent image, the potential is at or close to $V_o$, or approximately +800V. Accordingly, the positive toner particles experience a force in the direction $F_2$ which prevents migration of the toner to the photoconductive surface. In the image area, the potential on the photosensor surface is typically about +400V. Accordingly, at the photosensor image points, the attractive force with respect to the toner exceeds that with respect to the donor and the toner will transfer to the photoconductor, i.e. the force $F_1$ on the toner particles will be in the direction shown.

It should be clear that the broad principle of ambipolar development described above is applicable to many different photoconductive surfaces and donor members and should not be limited to the described embodiment. In addition, the term "direct" development includes positive-to-positive or negative-to-negative; "reversal" development refers to either negative-to-positive or positive-to-negative development.

While the foregoing description and drawings represent the preferred embodiments of the present invention, it will be obvious to those skilled in the art that various changes and modifications may be made therein without departing from the true spirit and scope of the present invention.

What is claimed is:

1. In xerographic apparatus of the type having a photosensitive xerographic plate, means for charging said plate to a voltage of a first polarity, means to expose said charged plate to a light image resulting in a latent charged image, and means for developing said latent image employing a touchdown donor having a surface adapted to being selectively charged, the improvement comprising:

means for charging the toner particles to a potential of polarity opposite said first polarity during a direct development mode and for charging the toner particles to a potential of the same polarity as said first polarity during a reversal development mode of a latent image;

variable means for charging the surface of the donor in the area of touchdown to a potential of the same polarity as said first polarity and means for selecting a mode of development.

2. The apparatus of claim 1 wherein said surface charging means charges the donor in the area of touchdown to about 60 to 200 volts higher than the background potential on the latent image in the direct development mode.

3. The apparatus of claim 1 wherein said donor surface charging means charges the donor in the area of touchdown to about 60 to 200 volts less than the charging potential for the photoconductive surface in the reversal mode.

4. The apparatus of claim 1 wherein said toner charging means charges said toner to a charge of 3 to 8 $\mu$ coulombs/gram.

5. The apparatus of claim 1 wherein, in the direct development mode, said xerographic plate charging potential is approximately +800 volts and said means for charging the donor in the touchdown area applies a potential of approximately +150 volts to the donor.

6. The apparatus of claim 1 wherein, in the reversal development mode, said xerographic plate charging potential is approximately +800 volts and said means for charging the donor in the touchdown area applies a potential of +700 volts to the donor.

7. The apparatus of claim 1 wherein said means for selecting a mode of development is an electrical switch for changing the potential on the donor in the touchdown area and for changing the polarity of charge on the toner particles.

8. The apparatus of claim 7 wherein said donor includes a plurality of stations, each station being controlled by a predetermined potential, two of said stations being a toner charging station and a donor touchdown station.

* * * * *